US005837930A

United States Patent [19]

Mul et al.

[11] Patent Number: 5,837,930

[45] Date of Patent: Nov. 17, 1998

[54] PROPELLANTS, IN PARTICULAR FOR THE PROPULSION OF VEHICLES SUCH AS ROCKETS, AND PROCESS FOR THEIR PREPARATION

[75] Inventors: Johannes Maria Mul, Haarlem; Herman Fedde Rein Schöyer, Zoetermeer; Ared Jean-Louis Schnorhk, Oegstgeest, all of Netherlands

[73] Assignees: Agence Spatiale Europeene, Paris, France; Nederlandse Organisatie Voor Toegepastnatuurwetenschappelijk Onderzoek TNO, The Hague, Netherlands

[21] Appl. No.: 347,349

[22] PCT Filed: Jul. 3, 1992

[86] PCT No.: PCT/FR92/00628

§ 371 Date: Oct. 6, 1995

§ 102(e) Date: Oct. 6, 1995

[87] PCT Pub. No.: WO93/01151

PCT Pub. Date: Jan. 21, 1993

[30] Foreign Application Priority Data

| | | | |
|---|---|---|---|
| Jul. 4, 1991 | [FR] | France | 91 08382 |
| Jul. 4, 1991 | [FR] | France | 91 08383 |
| Jul. 4, 1991 | [FR] | France | 91 08384 |

[51] Int. Cl.[6] ..... C06B 45/10

[52] U.S. Cl. ..... 149/19.6; 149/19.4; 149/19.92; 149/89

[58] Field of Search ..... 1419/19.4, 19.6, 1419/89

[56] References Cited

U.S. PATENT DOCUMENTS

| | | | |
|---|---|---|---|
| 3,657,028 | 4/1972 | Pannell | 149/36 |
| 3,658,608 | 4/1972 | Low | 149/36 |
| 3,708,359 | 1/1973 | Low | 149/36 |
| 3,844,855 | 10/1974 | Plomer et al. | 149/19.1 |
| 3,870,578 | 3/1975 | Nichols | 149/19.4 |
| 4,707,540 | 11/1987 | Manger et al. | 149/19.6 |
| 4,938,814 | 7/1990 | Schoyer et al. | 149/19.9 |
| 4,950,341 | 8/1990 | Schoyer et al. | 149/36 |

*Primary Examiner*—Edward A. Miller
*Attorney, Agent, or Firm*—Sughrue, Mion, Zinn, Macpeak & Seas, PLLC

[57] ABSTRACT

Ergols, particularly for propelling missiles, containing at least one oxidant, a fuel and an energy-releasing binder. The oxidant is selected from the group which includes a nitroformate of a nitrogen compound, particularly hydrazinium or ammonium nitroformate, and a perchlorate of a nitrogen compound, particularly nitronium or ammonium perchlorate. The fuel is selected from the group which includes boron and boranes, aluminium and aluminium hydribe. The energy-releasing binder is selected from the group which includes polyglycidyl nitrate, polyglycidyl azide, polynitromethoxymethyloxetane and poly-3,3bis(azidomethyl) oxetane. Said ergols are particularly useful for propelling aerospace missiles, particularly rockets.

5 Claims, No Drawings

PROPELLANTS, IN PARTICULAR FOR THE PROPULSION OF VEHICLES SUCH AS ROCKETS, AND PROCESS FOR THEIR PREPARATION

The present invention relates to propellants, in particular for the propulsion of vehicles such as, for example, rockets, of the type comprising at least an oxidizer, a fuel and an energetic binder.

Requirements for high performance propellants or mixtures of propellants exist generally in many industrial fields, in particular in the aerospace field, where these mixtures must be capable not only of being durably stored, for example in a space vehicle, in order to be employed at any time to modify its trajectory, but also to be used to launch it.

Hitherto, extensive use has been made of cryogenic mixtures based on liquid oxygen and hydrogen, which are found to be highly effective for feeding rocket engines which, in particular, place telecommunication satellites and other space vehicles in orbit.

However, these cryogenic mixtures are difficult to keep stored and their handling is hazardous and frequently a source of accidents.

To overcome these disadvantages it is known to replace these cryogenic mixtures with mixtures of propellants consisting at least of an oxidizing agent and of a fuel agent, which can be stored easily and durably without requiring special safety conditions, but these mixtures generally offer performances which are greatly inferior to those offered by cryogenic mixtures.

To make a comparison by considering one of the parameters which characterizes these mixtures, namely the specific impulse (which will be defined later), this impulse is higher than 4000 m/s in the case of cryogenic mixtures whereas, it is only approximately 3000 m/s in the case of a mixture of propellants consisting of nitrogen tetroxide ($N_2O_4$) and monomethylhydrazine ($N_2H_3CH_3$), for example.

Under these conditions, if a velocity of 2000 m/s is necessary to put a space vehicle into orbit or to modify its trajectory, half the mass of the space vehicle must be dedicated to a propellant agent capable of producing a specific impulse of 2943 m/s. On the other hand, with a specific impulse of 4415 m/s, the mass of the propellant agent would be reduced to 37.5%, thus offering a mass saving of approximately 12.5%, which could be advantageously employed, for example, for launching telecommunication satellites. In other words, by increasing the specific impulse it is possible to reduce the mass of the propellant agent and to increase the payload carried onboard the space vehicle. To give an example, in the case of a 2000 kg space vehicle, the payload increase is of the order of 250 kg.

Given that only cryogenic mixtures made it possible to obtain specific impulses higher than 4000 m/s, attempts have been made to increase the energetic power of mixtures of propellants and thus to preserve the advantages which they offer where their storage is concerned.

U.S. Pat. No. 4,938,814, in the name of the Applicant Company discloses a heterogeneous mixture of propellants comprising at least a solid oxidizer consisting of hydrazinium nitroformate, a fuel consisting of di- or pentaborane, and an energetic binder consisting of polyglycidyl azide $(C_3H_5N_3O)_n$ or of poly-3,3-bis(azidomethyl) oxetane $(C_4H_5N_6O)_n$.

In addition U.S. Pat. No. 4,950,341, also in the name of the Applicant Company discloses a solid mixture of propellants comprising at least an oxidizer chosen from the group which comprises hydrazinium nitroformate, nitronium perchlorate and ammonium perchlorate, a fuel chosen from the group which comprises boron, aluminum and aluminum hydride, and an energetic binder chosen from the group which comprises polyglycidyl aside and poly-3,3-bis (azidomethyl)oxetane.

The mixtures according to U.S. Pat. No. 4,938,814 and U.S. Pat. No. 4,950,341 provide propellants agents which have performances close to those of cryogenic mixtures.

It has furthermore been proposed [cf. K. Kubota et al., Kogyo Kagaku Kyokaishi 27(3), p.169–173 (1966)] to employ, in the case of composite fuels, a polymeric binder consisting of a fuel resin synthesized by addition polymerization of glycol and of glycidyl nitrate in the presence of a Friedel and Crafts catalyst to form a polynitratoglycol which, on reaction with a polyol and a polyisocyanate, yields a nitratourethane, which is the binder recommended by the authors for use with fuels which, however, are not identified.

The aim of the present invention is to provide propellants which are better suited to the requirements of the propulsion of vehicles of the rocket type and other space vehicles than the propellants proposed in the prior art, especially in that they offer a high specific impulse, in that they are capable of being stored for prolonged periods before being employed and in that their combustion products do not contribute to atmospheric pollution.

The subject of the present invention is consequently a propellant, in particular for the propulsion of aerospace vehicles, of the type comprising at least an oxidizer, a fuel and a binder, which propellant is characterised in that:

the oxidizer is chosen from the group which comprises a nitroformate of a nitrogen compound, and especially a hydrazinium or ammonium nitroformate, and a perchlorate of a nitrogen compound, especially a nitronium or ammonium perchlorate;

the fuel is chosen from the group which comprises boron and boranes, aluminum and aluminum hydride;

the energetic binder is chosen from the group which comprises polyglycidyl nitrate, polyglycidyl azide, polynitromethoxymethyloxetane and poly-3,3-bis(azidomethyl) oxetane.

According to an advantageous embodiment of the propellant in accordance with the present invention, the propellant is a solid propellant, in which case:

the oxidizer is chosen from hydrazinium nitroformate, ammonium nitroformate, ammonium perchlorate and nitronium perchlorate;

the fuel is chosen from boron, aluminum and aluminum hydride;

the energetic binder is chosen from polyglycidyl nitrate and polynitromethoxymethyloxetane.

According to another advantageous embodiment of the propellant in accordance with the present invention, the propellant is a heterogeneous propellant, in which case:

the oxidizer is hydrazinium nitroformate;

the fuel is chosen from diborane and pentaborane;

the energetic binder is chosen from the group which comprises polyglycidyl nitrate and polynitromethoxymethyloxetane.

According to yet another advantageous embodiment of the propellant in accordance with the present invention, the propellant is a heterogeneous propellant, in which case:

the oxidizer is ammonium nitroformate;

the fuel is chosen from the group which comprises diborane, pentaborane and aluminum;

the energetic binder is chosen from the group which comprises polyglycidyl nitrate, polyglycidyl azide, polynitromethoxymethyloxetane and poly-3,3-bis(azidomethyl) oxetane.

According to an advantageous embodiment of the propellant in accordance with the present invention, it additionally contains appropriate additives which act as stabilizing agents and anticorrosion agents.

According to an advantageous variation of the invention, the solid propellant defined above contains the energetic binder in a proportion which does not exceed 35% by weight of the total weight of the propellant.

According to another advantageous variation of the invention, the heterogeneous propellants defined above contain the energetic binder in a proportion which does not exceed 10% by weight of the total weight of the propellant.

The propellants in accordance with the present invention are obtained by mixing at least an oxidizer, a fuel and an energetic binder such as those defined above.

In the following, the different components of the propellants in accordance with the present invention, which are all known per se, will be identified either by their chemical formula or by their abbreviations:

| | |
|---|---|
| the oxidizer: | |
| hydrazinium nitroformate | $N_2H_5C(NO_2)_3$ or HNF |
| ammonium nitroformate | $NH_4C(NO_2)_3$ or ANF |
| nitronium perchlorate | $NO_2ClO_4$ |
| ammonium perchlorate | $NH_4ClO_4$ |
| the fuel: | |
| boron | B |
| diborane | $B_2H_5$ |
| pentaborane | $B_5H_9$ |
| aluminum | Al |
| aluminum hydride | $AlH_3$ |
| the energetic binder: | |
| polyglycidyl nitrate: | |
| $(C_3H_5NO_4)_4$ or PGN | |
| polyglycidyl azide: | |
| $(CH_2—CH—COO—CO—N_3)_n$ or GAP (O) | |
| polynitromethoxymethyloxetane: | |
| $(C_5H_9NO_4)_n$ or poly(NIMMO) | |
| poly-3,3-bis (azidomethyl) oxetane: | |
| $(NO_2—CH_3O—CH_2—CH—CH_2—CH_2—O)_n$ or BAMO | |

The invention will be better understood with the aid of the examples which are to follow, in which preferred compositions of propellants in accordance with the present invention will be found, it being nevertheless understood that these examples are given solely by way of illustration of the invention and without any limitation being implied.

EXAMPLES

Example 1

Solid Propellants

Preferred examples of solid propellants in accordance with the invention are the following:

$N_2H_5(NO_2)_3$+B+PGN or poly(NIMMO),
$NO_2ClO_4$+B+PGN or poly(NIMMO),
$NH_4ClO_4$+B+PGN or poly (NIMMO),
$NH_4C(NO_2)_3$+B+PGN or poly(NIMMO),
$N_2H_5C(NO_2)_3$+Al+PGN or poly(NIMMO),
$NO_2ClO_4$+Al+PGN or poly(NIMMO),
$NH_4ClO_4$+Al+PGN or poly(NIMMO),
$NH_4C(NO_2)_3$+Al+PGN or poly(NIMMO),
$NO_2ClO_4$+$AlH_3$+PGN or poly(NIMMO),
$NO_2ClO_4$+$AlH_3$+PGN or poly(NIMMO),

Example 2

Hybrid Propellants

Preferred examples of hybrid propellants in accordance with the present invention are the following:

$N_2H_5C(NO_2)_3$+$B_5H_9$+PGN, or
$N_2H_5C(NO_2)_3$+$B_5H_9$+poly(NIMMO)
$NH_4C(NO_2)_3$+$B_5H_9$+GAP,
$NH_4C(NO_2)_3$+$B_5H_9$+BAMO,
$NH_4C(NO_2)_3$+$B_5H_9$+PGN,
$NH_4C(NO_2)_3$+$B_5H_9$+poly(NIMMO),
$NH_4C(NO_2)_3$+Al+GAP,
$NH_4C(NO_2)_3$+Al+BAMO,
$NH_4C(NO_2)_3$+Al+PGN,
$NH_4C(NO_2)_3$+Al+poly(NIMMO), With such mixtures it is possible to obtain specific impulses higher than 4000 m/s, the specific impulse $I_{sp}$, which characterizes a propellant agent in particular, being expressed by the formula:

$$Isp = \sqrt{2\gamma \cdot (\gamma^{-1})^{-1} \cdot R_o \cdot T_c \cdot M^{-1} \left[ 1 - \left( \frac{P_e}{P_c} \right)^{\frac{\gamma^{-1}}{\gamma}} \right]}$$

where:

$\gamma$ is the specific heat ratio $C_p/C_v$
$R_o$ the molecular constant for perfect gases,
$T_c$ the temperature of the combustion flame,
M the average molecular mass of the combustion products,
$P_c$ the pressure in the combustion chamber,
and $P_s$ the pressure at the nozzle exit.

The proportions by weight of the oxidizer and of the fuel forming part of the composition of these mixtures are not critical, according to the invention. In general these constituents are mixed with one another before the reaction, in proportions such that the ratios of the mixture lie in the region of the stoichiometric ratio in order to obtain the most complete combustion possible.

Good results, and in particular a satisfactory mechanical strength, are obtained when the quantity of energetic binder present in the solid propellant does not exceed 35% by weight of the total weight of the mixture and when, in the hybrid propellant, it does not exceed 10% by weight of the total weight of the mixture.

It is advantageous, furthermore, to add to the mixture preferably a few % by weight of components such as phthalates, stearates, lead or copper salts, black powder, and the like. These additives are known per se to increase the stability of the mixture without modifying its characteristics, especially combustion characteristics, and also to impart anticorrosion properties to the mixture.

Metals and metal hydrides are preferably excluded from the additional components.

It should be noted that the combustion gases of these mixtures are cleaner when the oxidizers employed (HNF or ANF) do not contain chlorine, and, as a result, the external environment is not polluted with hydrochloric acid.

The mixtures according to the invention are stored according to known techniques before use, it being possible for the individual components, namely the oxidizer and the fuel, to be generally either stored in separate storage containers or in a combustion chamber, or, especially in the case of solid propellants, to be stored in the form of the oxidizer+fuel+energetic binder mixture.

The invention is not limited to the methods of preparation, of use and of application which are described above. It includes all the alternative forms of embodiment and of application within the reach of a person skilled in the art that come within the scope and the range of the present invention.

We claim:

1. A solid propellant for the propulsion of aerospace vehicles comprising at least an oxidizer, a fuel and an energetic binder;

wherein the oxidizer is ammonium nitroformate;

wherein the fuel is selected from the group consisting of boron, aluminum and aluminum hydride; and wherein the energetic binder is selected from the group consisting of polyglycidyl nitrate, and polynitromethoxymethyloxetane.

2. The solid propellant according to claim 1, further comprising at least one additive which acts as a stabilizing agent and an anticorrosion agent.

3. The solid propellant according to claim 1, wherein the energetic binder is present in a proportion which does not exceed 35% by weight of the total weight of the propellant.

4. A process for the preparation of a solid propellant for the propulsion of aerospace vehicles, comprising mixing at least an oxidizer, a fuel and an energetic binder;

wherein the oxidizer is ammonium nitroformate;

wherein the fuel is selected from the group consisting of boron, aluminum and aluminum hydride; and wherein the energetic binder is selected from the group consisting of polyglycidyl nitrate, and, polynitromethoxymethyloxetane.

5. The process according to claim 4, further comprising mixing at least one additive which acts as a stabilizing agent and an anticorrosion agent with the at least one oxidizer, the fuel and the energetic binder.

* * * * *